US011965721B2

(12) United States Patent
Lafortune

(10) Patent No.: US 11,965,721 B2
(45) Date of Patent: Apr. 23, 2024

(54) CLOSURE DISK ASSEMBLY FOR TRACER PROJECTILE

(71) Applicant: General Dynamics Ordnance and Tactical Systems—Canada, Inc., Repentigny (CA)

(72) Inventor: Eric Lafortune, Repentigny (CA)

(73) Assignee: GENERAL DYNAMICS ORDNANCE AND TACTICAL SYSTEMS—CANADA, INC., Repentigny (CA)

( * ) Notice: Subject to any disclaimer, the term of this patent is extended or adjusted under 35 U.S.C. 154(b) by 39 days.

(21) Appl. No.: 17/931,795

(22) Filed: Sep. 13, 2022

(65) Prior Publication Data

US 2024/0093979 A1 Mar. 21, 2024

(51) Int. Cl.
*F42B 12/38* (2006.01)
*F42B 33/00* (2006.01)
*F42B 10/38* (2006.01)

(52) U.S. Cl.
CPC ..... *F42B 12/38* (2013.01); *F42B 33/001* (2013.01); *F42B 10/38* (2013.01)

(58) Field of Classification Search
CPC ..... F42B 12/38; F42B 12/382; F42B 10/38; F42B 10/40; F42B 10/42; F42B 10/44; F42B 33/00; F42B 33/001
USPC ..... 102/364, 473, 490, 513, 517
See application file for complete search history.

(56) References Cited

U.S. PATENT DOCUMENTS 3,677,181 A * 7/1972 Giljarhus ..... F42B 12/44 102/364
3,710,723 A * 1/1973 Muller ..... F42B 12/38 102/513
3,972,291 A * 8/1976 Braun, Jr. ..... F42B 12/38 149/43
4,202,246 A 5/1980 Ritter et al.
4,807,535 A * 2/1989 Schilling ..... F42B 10/40 102/490
6,655,293 B1 12/2003 Henry et al.
7,985,311 B2 7/2011 Guindon et al.
8,066,833 B2 * 11/2011 Guindon ..... C06B 23/007 149/75
9,188,415 B2 * 11/2015 Pfaff ..... F42B 33/001

FOREIGN PATENT DOCUMENTS

GB 657714 A 9/1951

* cited by examiner

*Primary Examiner* — James S Bergin
(74) *Attorney, Agent, or Firm* — Lorenz & Kopf, LLP

(57) ABSTRACT

The tracer projectile having a closure disk assembly is described. The tracer projectile includes a projectile base with a tracer cavity formed therein. A pyrotechnic charge is pressed into the tracer cavity and is ignitable by burning propellant such that a trajectory of the projectile is visible when fired. A closure disk assembly covers and seals the tracer cavity. A crown of the closure disk assembly is supported on a ring flange formed by an annular groove in the projectile base. A sidewall of the closure disk assembly surrounds the ring flange. A retaining element is disposed in the annular groove and engages a rim of the closure disk assembly for securing the closure disk assembly to the projectile base over the tracer cavity.

20 Claims, 7 Drawing Sheets

CLOSURE DISK ASSEMBLY FOR TRACER PROJECTILE

TECHNICAL FIELD

The present disclosure relates generally to an ammunition round for a weapon system having a projectile with tracer functionality, and more particularly to a closure disk assembly with a compact configuration for tracer projectiles having limited space to introduce such an assembly, for example rear finned medium and large caliber projectiles.

BACKGROUND

This section provides background information related to the present disclosure which is not necessarily prior art.

Tracer projectiles are constructed with a hole or cavity at the base of the projectile into which a small pyrotechnic charge is pressed. When the projectile is fired, the pyrotechnic charge, which is ignited by the burning propellant gases, burns very brightly making the projectile trajectory visible to the naked eye during daylight and very bright during nighttime. There are different types of tracers such as subdued tracers which start to burn brightly when the projectile is down range and dim tracers which burn dimly but are clearly visible with night vision equipment. Tracer projectiles are commonly used in various military training and combat tactics. Tracer projectiles may be produced for many small caliber, medium caliber and some large caliber ammunition.

It is good practice for a tracer projectile to include a tracer sealing device in order to protect the pyrotechnic composition from humidity and to prevent spilling of loosened pyrotechnic powder that may occur during cartridge assembly operations or resulting from vibration and impact loads during transportation and handling of the cartridge. Firing the ammunition is intended to rupture the tracer sealing device so that the tracer composition may be ignited by the burning propellant gases as the projectile is accelerated through the barrel of the weapon system. Projectiles propelled through the barrel reach high velocities, typically 800 m/s to 1500 m/s, thereby exiting the barrel in a very short time interval, typically less than 5 milliseconds. Thus, the tracer ignition performance must be met within these extreme conditions. Consequently, to ensure reliable tracer ignition, upon firing, the burning propellant gas pressure must easily rupture the sealing device. If not properly configured, the sealing device may extrude inside the tracer cavity, instead of rupturing, and delay or inhibit the ignition of the pyrotechnic composition resulting in unreliable tracer ignition.

A tracer projectile 10 having a conventional tracer sealing device 12 is illustrated in FIGS. 1 and 2. The tracer projectile 10, typically used in medium and large caliber ammunitions, includes a projectile body 14 having a relatively small diameter tracer cavity 16 formed in the base 18 of the projectile body 14 for receiving a pyrotechnic charge. A relatively large diameter brass disk 20 lays on top of the projectile base 18 and covers the tracer cavity 16. The brass disk 20 is held in place by a large diameter steel ring 22 secured on the rear face 24 of the projectile base 18. The brass disk 20 is sandwiched in place between the projectile base 18 and the ring 22 so that burning propellant gases rupture the disk and ignite the pyrotechnic charge. As best seen in FIG. 1, the brass disk 20 and ring 22 nearly covers the entire rear face 24 of the projectile base 18 for achieving the required retaining force therebetween. And yet, in some instances the ring 22 fails to adequately secure the brass disk 20 to the projectile base 18 allowing the brass disk 20 to extrude into the tracer cavity 16, rather than rupturing. As a result, the pyrotechnic charge is not ignited.

Some tracer projectiles may include rear fins for applications such as reduced range ammunition where the rear fin surface decelerates the projectile spin to gyroscopically de-stabilize the projectile at a given range. Other types of projectile in the medium and large caliber ammunition may be high velocity subcaliber rear fin stabilized configuration for armor piercing. Other types of projectiles in the medium or lager caliber ammunition may also have limited space at the projectile base depending on the application. For such applications, the use of conventional tracer sealing devices assemblies as heretofore described must not affect the ballistic performance making it difficult to introduce a reliable tracer closure disk.

Accordingly, it is desirable to provide a closure disk assembly for a tracer projectile that is simple and compact in design, particularly for medium or large caliber ammunitions, and that will reliably rupture upon firing to ensure ignition of the pyrotechnic charge. In addition, it is desirable to provide an assembly method for a tracer projectile that is straightforward and efficient to execute in a reliable and repeatable matter. Furthermore, other desirable features and characteristics of the present invention will become apparent from the subsequent detailed description of the invention and the appended claims, taken in conjunction with the accompanying drawings and this background of the invention.

SUMMARY

This disclosure provides a closure disk assembly for tracer projectiles having limited space to introduce such assemblies, and an associated assembly method for introducing such a closure disk assembly in a compact configuration. This technique is particularly well suited for medium and large caliber projectiles to introduce a tracer closure disk assembly having an effective compact solution that will not impact the tracer ignition. The tracer closure disk may further benefit with sealing the pyrotechnic composition from moisture and ensure safe assembly, handling and transportation.

In one embodiment, the projectile configuration may include rear fins for applications such as reduced range ammunition where the rear fin surface decelerates the projectile spin to gyroscopically destabilize the projectile at a given range. In another embodiment, medium or large caliber ammunition may include a high velocity subcaliber rear fin stabilized projectile for armor piercing. Other types of projectiles in the medium or lager caliber ammunition may also have limited space at the projectile base depending on the application. The use of a closure disk assembly in accordance with the present disclosure will not affect the ballistic performance of these projectiles, while at the same time will provide a functional tracer round for such applications.

BRIEF DESCRIPTION OF THE DRAWINGS

The drawings described herein are for illustrative purposes only of selected embodiments that do not represent all possible implementations and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. There is no intention to be limited by any principle presented in the preceding background or the following detailed description.

With reference now to FIGS. 3-14, embodiments of a tracer projectile having a closure disk assembly in accordance with the present disclosure are illustrated. The tracer projectile includes a projectile having a tracer cavity formed into a projectile base. A pyrotechnic charge is pressed into the tracer cavity and can be ignited by burning propellant such that a trajectory of the projectile is visible when fired through the barrel of a weapon system. A closure disk assembly covers and seals the tracer cavity. Specifically, a crown of the closure disk assembly is supported on a ring flange formed by an annular groove in the projectile base. A sidewall of the closure disk assembly surrounds the ring flange, a slight press-fit joint may be formed when these two components are pushed together. A retaining element is disposed in the annular groove and engages a rim of the closure disk assembly for securing the closure disk assembly to the projectile base over the tracer cavity.

Figure 1:
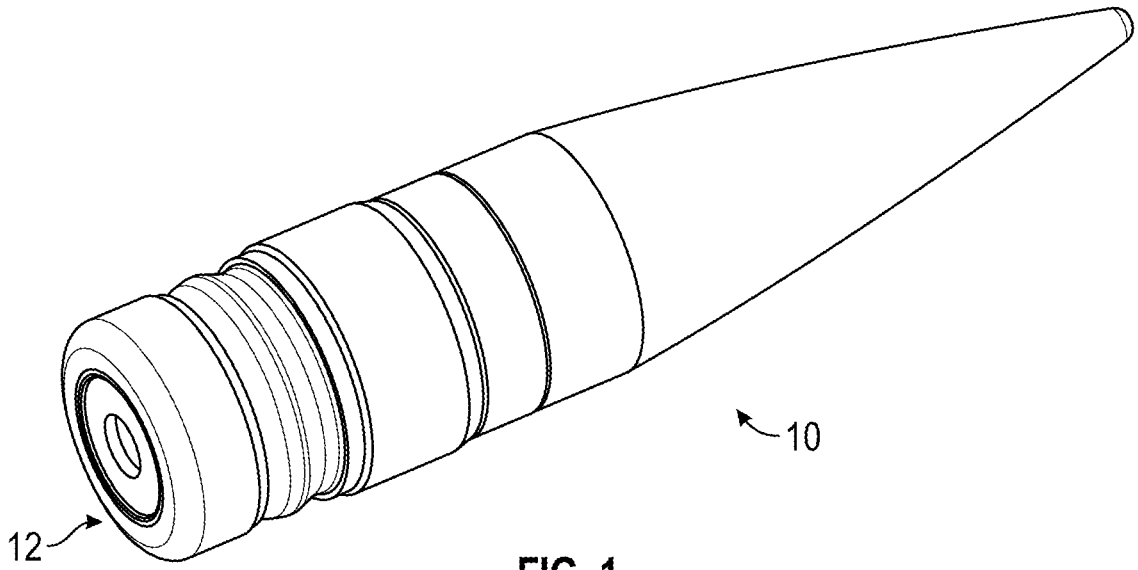
FIG. 1 (Prior Art)
FIG. 1 is a perspective view of a projectile having a conventional tracer sealing device.
Figure 2:
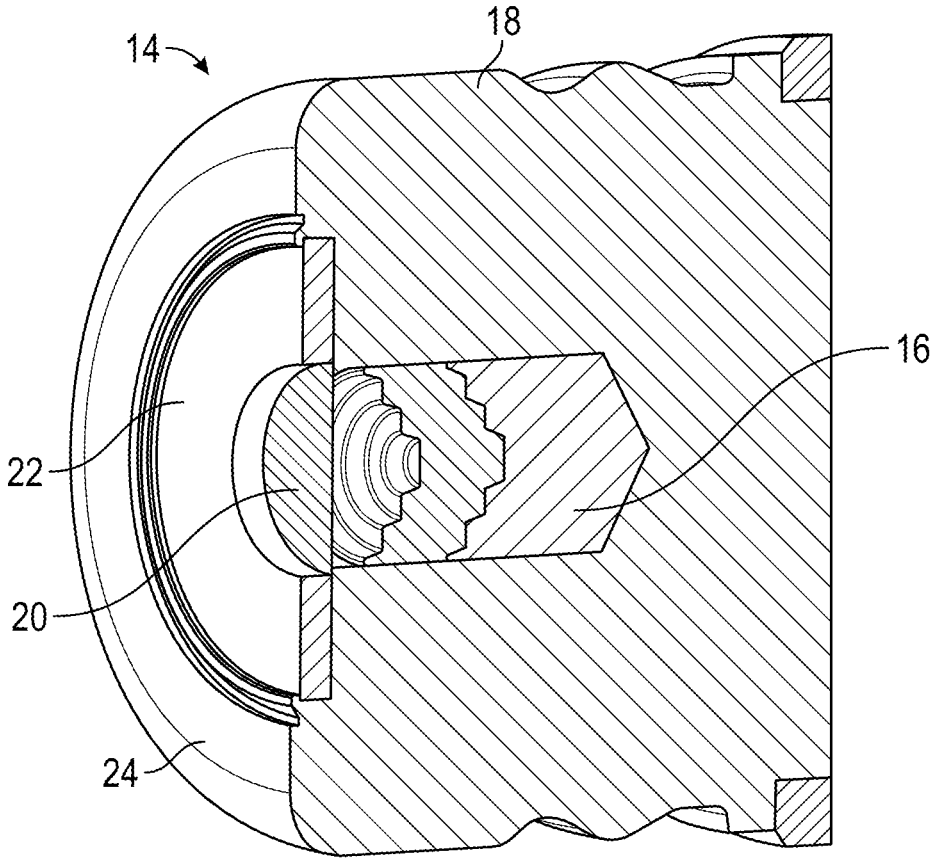
FIG. 2 (Prior Art)
FIG. 2 is a partial cross-section of the projectile shown in FIG. 1.

With this configuration of the closure disk assembly, the ring flange and the retainer element firmly secures the closure disk assembly to the projectile base for ensuring gas pressure from burning propellant ruptures the closure disk assembly when the projectile is fired, thus eliminating the likelihood that the closure disk assembly will extrude into the tracer cavity. One skilled in the art will appreciate that a closure disk assembly so configured requires much less surface area on a rear face of the projectile base section than the conventional tracer sealing device illustrated in FIGS. 1 and 2.

The closure disk assembly may be made of a metal selected from the group consisting of copper, copper alloy, aluminum, aluminum alloy, or steel. Alternately, the closure disk assembly may be made of a polymeric material. A closure disk assembly in accordance with the present disclosure is particularly well-suited for use on tracer projectiles having a set of rear fins formed on the projectile base. Likewise, a closure disk assembly in accordance with the present disclosure is particularly well-suited for used on a medium caliber projectiles in a caliber range of 20 mm-40 mm (e.g., 20 mm, 25 mm, 30 mm, 35 mm, 40 mm or similar medium caliber projectiles) and large caliber projectiles in a caliber range of 57 mm-155 mm (e.g., 57 mm, 76 mm, 105 mm, 120 mm, 155 mm or similar large caliber projectiles).

With reference now to FIGS. 3-8, an embodiment of a tracer projectile 100 is illustrated. The tracer projectile 100 includes a projectile body 102 having a forward section 104, a mid-section 106 and a projectile base or base section 108. The forward section has a threaded portion 110 formed thereon for receiving and supporting an ogive 112. The mid-section 106 has a contoured region 114 formed therein for receiving and supporting a polymeric driving band 116. The base section 108 has a tracer cavity 118 formed in a rear face 120 thereof. An annular groove 122 is also formed into the rear face 120 of the base section 108 to provide a ring flange 124 surrounding the tracer cavity 118. A pyrotechnic charge 126 is pressed into the tracer cavity 118. The pyrotechnic charge 126 includes an igniter composition 128 that is ignited by burning propellant when the tracer projectile 100 is initially fired and a tracer composition 130, which is ignited by the igniter composition 128 rendering a trajectory of the projectile visible when fired through the barrel of the weapon system. A closure disk assembly 132 covers and seals the tracer cavity 118. FIGS. 9-14 illustrate other embodiments of the base section 208, 308, 408 and closure disk assembly 232, 332, 432 that may be configured in the tracer projectile 100 described above.

With reference again to FIGS. 3-8, the closure disk assembly 132 is formed with a hat- or cup-shaped configuration having a thin-walled crown 134 covering the tracer cavity 118, a sidewall 136 extending into the annular groove 122 along an inner surface 138 of the annular groove 122 and a rim 140 extending radially out from the sidewall 136 along an inner face 142 of the annular groove 122. The ring flange 124 supports the crown 134 on the base section 108. The dimensions of the sidewall 136 relative to the inner surface 138 of the annular groove 122 may be configured to provide a slight press-fit joint which is held together by friction when these two components are pushed together.

Figure 3:
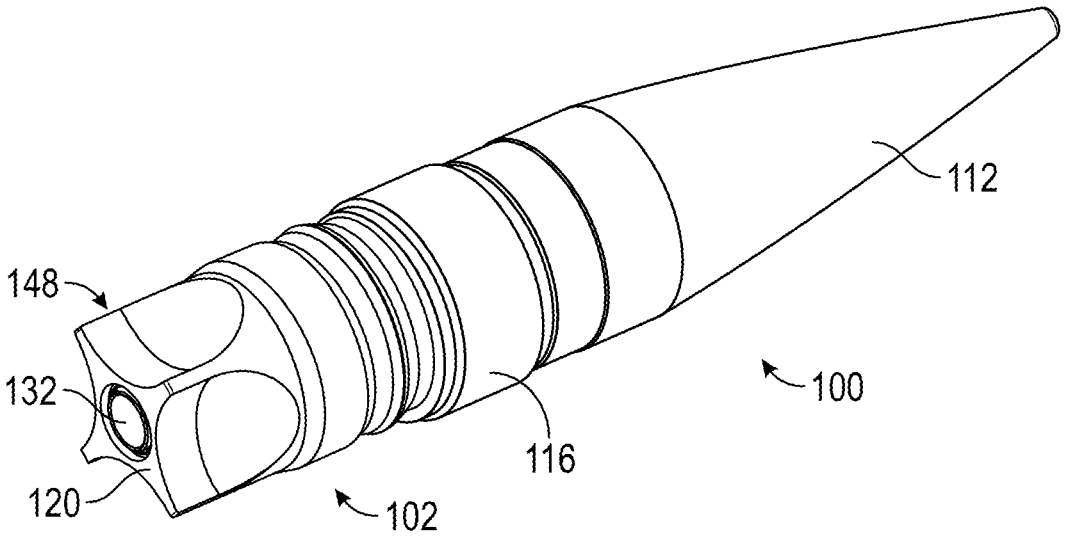
FIG. 3 is a perspective view of a projectile having a closure disk assembly in accordance with a first embodiment.
Figure 4:
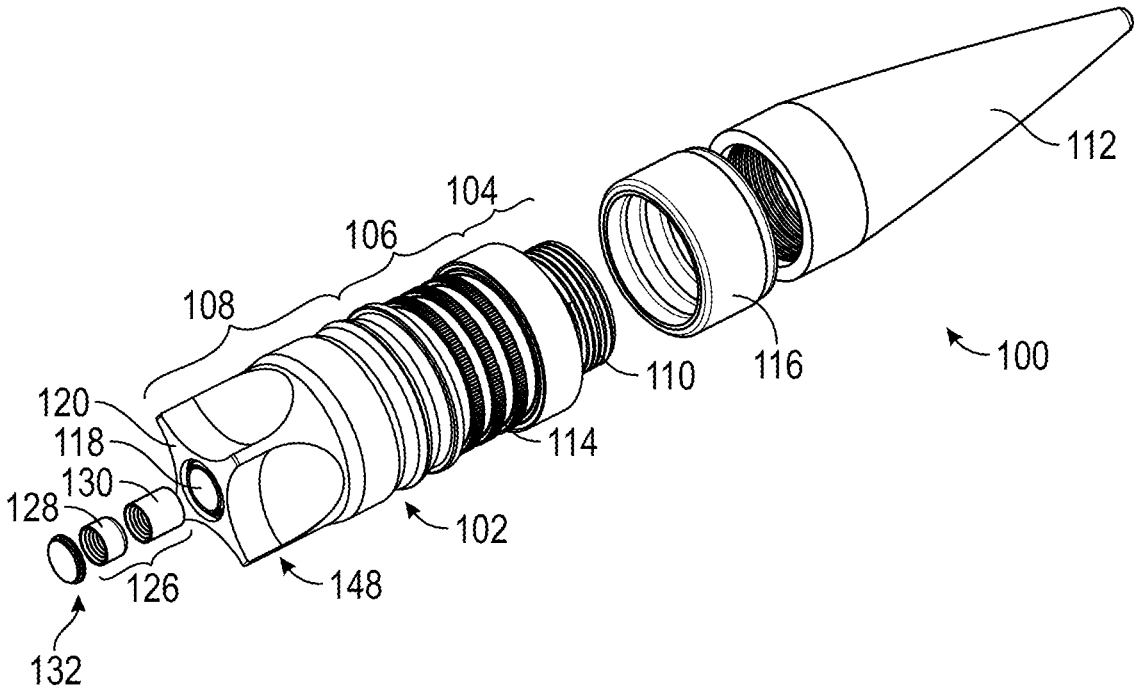
FIG. 4 is an expanded view of the projectile shown in FIG. 3.
Figure 5:
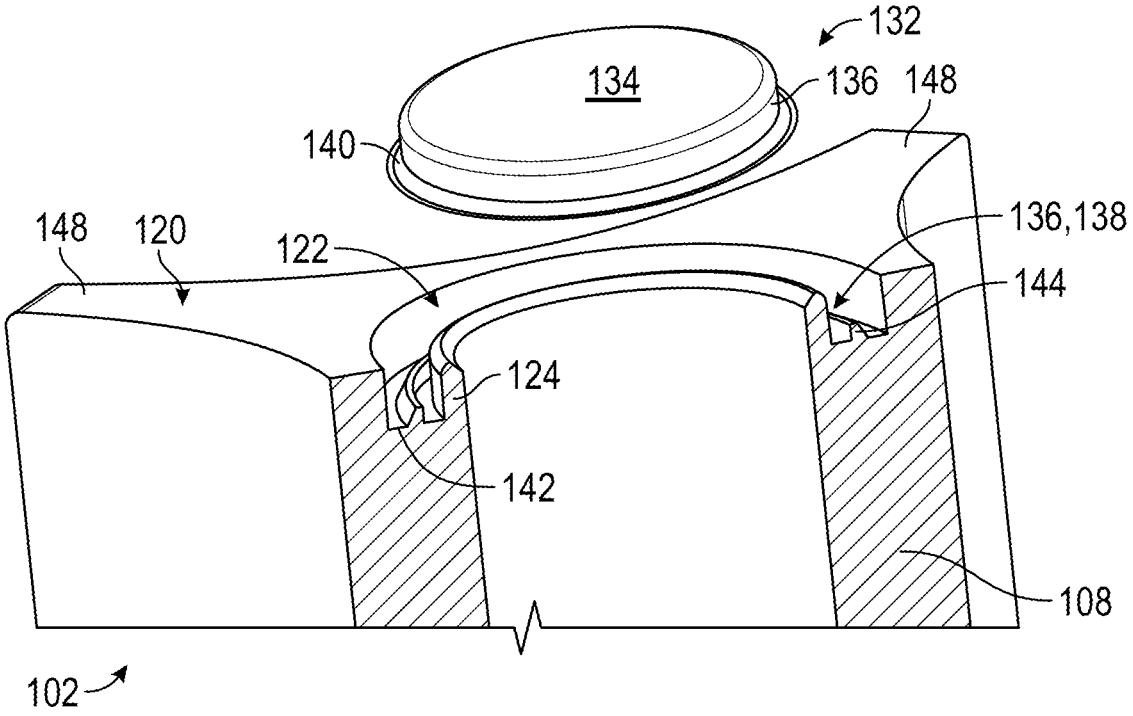
FIG. 5 is a partial cross-section of the projectile shown in FIG. 3 in an expanded condition.
Figure 6:
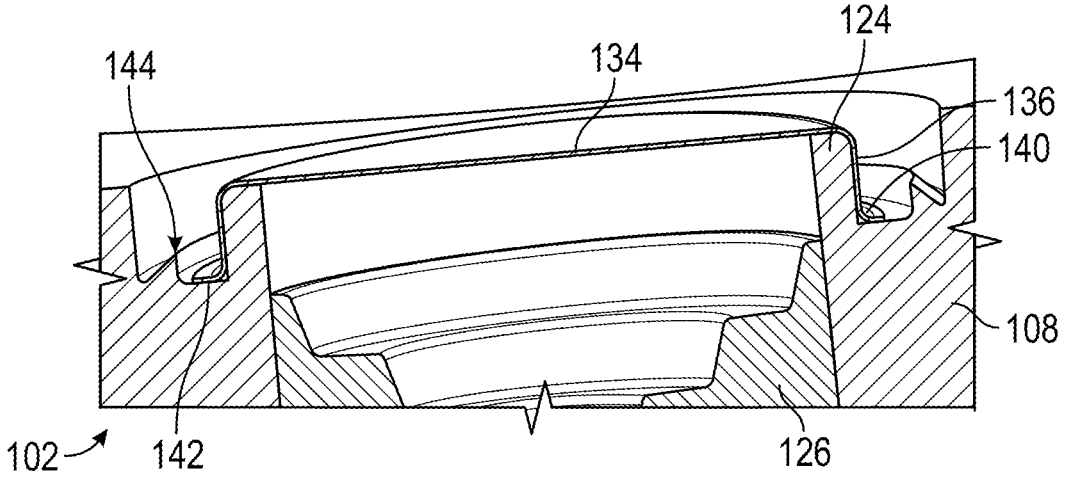
FIG. 6 is a partial cross-section of the projectile base shown in FIG. 3 in a partially assembled condition.
Figure 7:
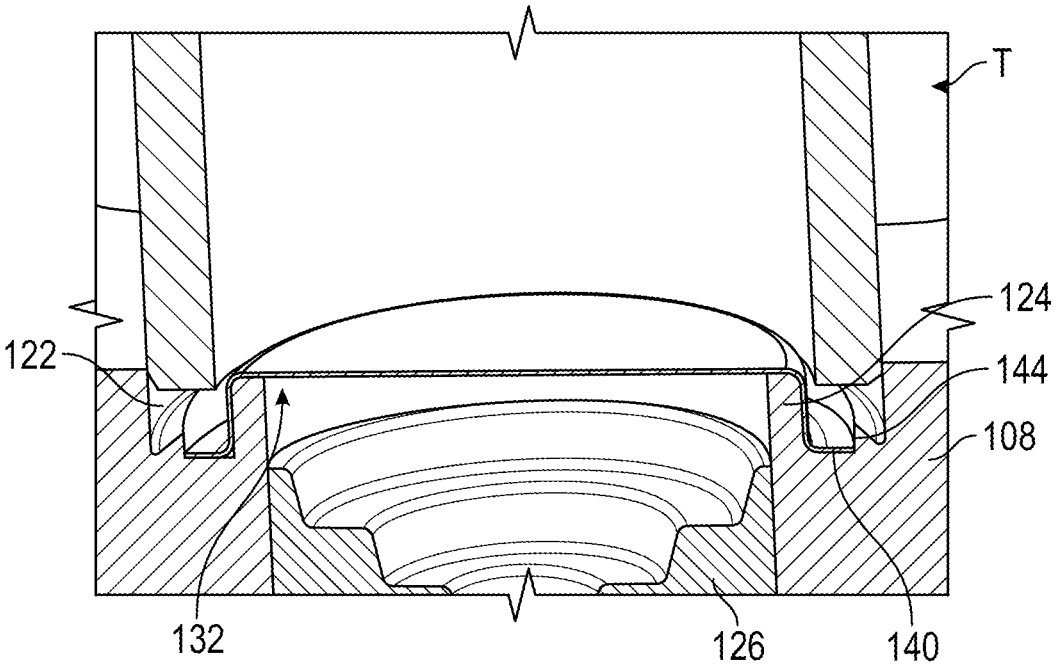
FIG. 7 is a partial cross-section of the projectile shown in FIG. 3 during a forming operation.
Figure 8:
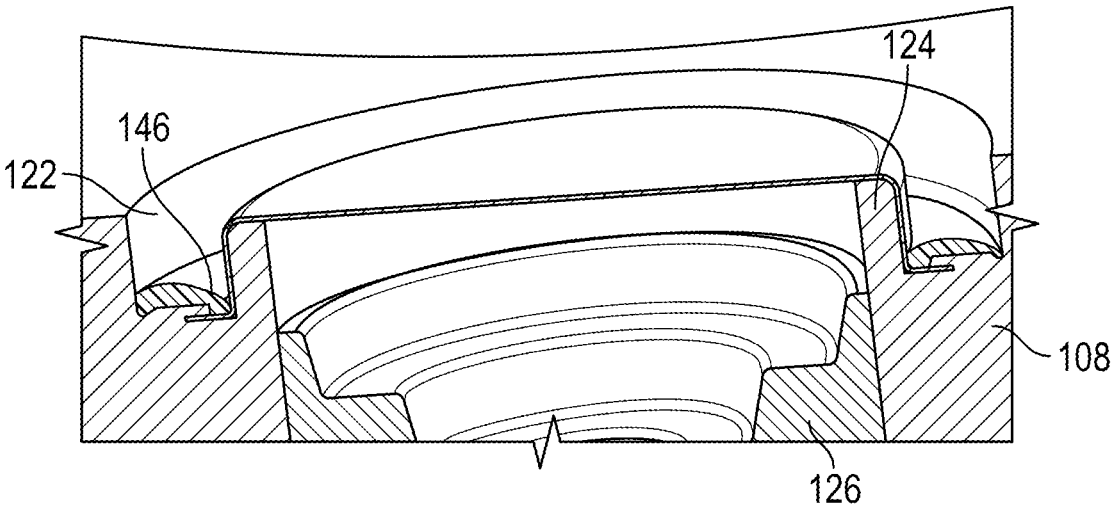
FIG. 8 is a partial cross-section of the projectile shown in FIG. 3 in an assembled condition.

With particular reference to FIGS. 5-8, a malleable crimping flange 144 extends from an inner face 142 of the annular groove 122. As shown in FIG. 7, a forming tool T is axially inserted into the annular groove 122 for applying a downward force on the malleable crimping flange 144, which is crimped over the rim 140 to form a crimp set. As best seen in FIG. 6, the malleable crimping flange 144 has a triangular cross-section to provide a tapered crimping flange 144 that is formed over the rim 140. The cross-section shape of the crimping flange 144 may have other configurations based the design specifications and performance requirements of the tracer projectile 100. Once so formed the crimping flange 144 functions as a retaining element for securing the closure disk assembly 132 to the projectile base 108 over the tracer cavity 118. A sealant 146 (such as a lacquer sealer) may be disposed in the annular groove 122 once the crimp set is formed to provide a humidity barrier for the pyrotechnic charge 126. As best seen in FIGS. 3-4, the projectile body 102 includes a plurality of fins 148 formed into the base section 108. The number, spacing and shape of the fins 148 may be configured to achieve the desired functionality and performance requirement of the tracer projectile 100.

Figure 9:
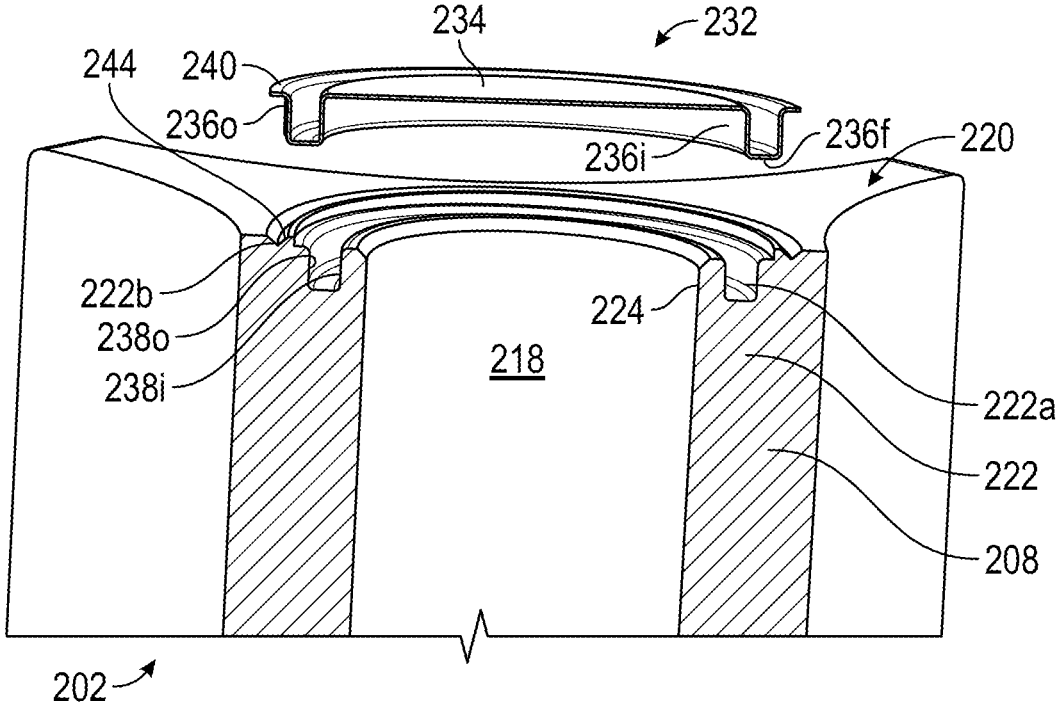
FIG. 9 is a partial cross-section of a projectile in accordance with a second embodiment shown in an expanded condition.
Figure 10:
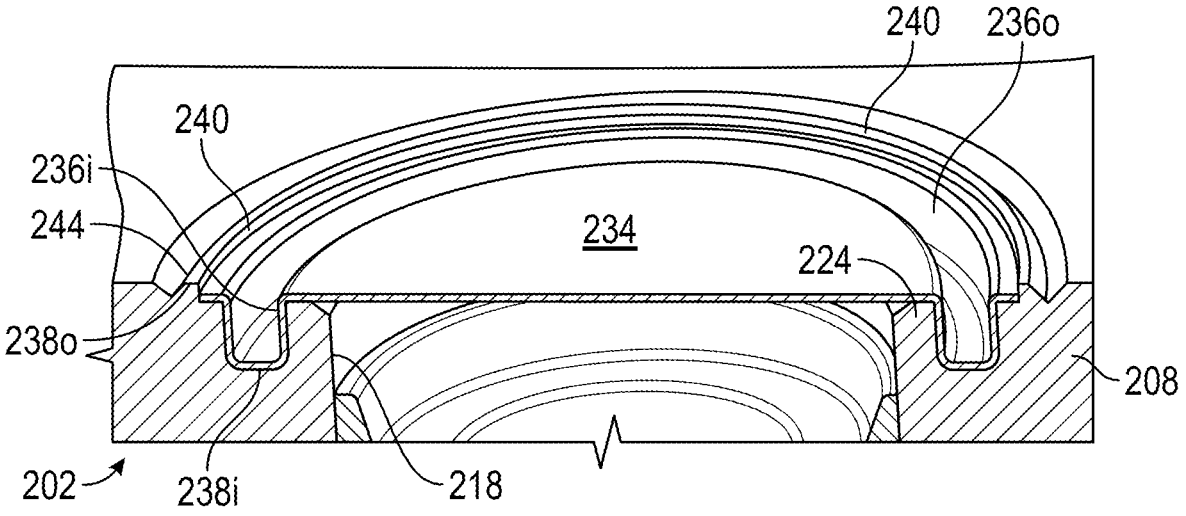
FIG. 10 is a partial cross-section of the projectile shown in FIG. 9 in an assembled condition.

With reference now to FIGS. 9-10, an embodiment of a projectile body 202 is illustrated. Projectile body 202, which is similar to projectile body 102, includes certain modifications to the annular groove and the closure disk assembly as hereinafter described. Similar features of projectile body 202 may be gleaned from the earlier description of projectile body 102 and tracer projectile 100, which will not be further explained.

The projectile body 202 includes a projectile base 208 having a tracer cavity 218 formed in a rear face 220 thereof. An annular groove 222 is also formed into the rear face 220 of the projectile base 208 to provide a ring flange 224 surrounding the tracer cavity 218. The annular groove 222 has a stepped cross-section to provide a well portion 222*a* and a shoulder portion 222*b* formed radially outward of the well portion 222*a*. The well portion 222*a* is formed deeper into the projectile base 208 than the shoulder portion 222*b*. A closure disk assembly 232 covers and seals the tracer cavity 218.

The closure disk assembly 232 is formed with a modified hat- or cup-shaped configuration having a thin-walled crown 234 covering the tracer cavity 218, a bead 236 extending into the well portion 222*a* of the annular groove 222 and a rim 240 extending along the shoulder portion 222*b* of the annular groove 222. The bead 236 includes a pair of sidewalls 236*i*, 236*o* and a flange 236*f* extending therebetween. The ring flange 224 supports the crown 234 on the projectile base 208. The dimensions of the sidewalls 236*i*, 236*o* relative to the radial surfaces 238*i*, 238*o* of the well portion 222*a* of the annular groove 222 may be configured to provide a slight press-fit joint which is held together by friction when the closure disk assembly 232 and the projectile base 208 are pushed together. A malleable crimping flange 244 extends from the shoulder portion 222*b* of the annular groove 222. A forming tool (not shown) is axially inserted into the shoulder portion 222*b* for applying a downward force on the malleable crimping flange 244, which is crimped over the rim 240 to form a crimp set. Once so formed the crimping flange 244 functions as a retaining element for securing the closure disk assembly 232 to the projectile base 208 over the tracer cavity 218.

Figure 11:
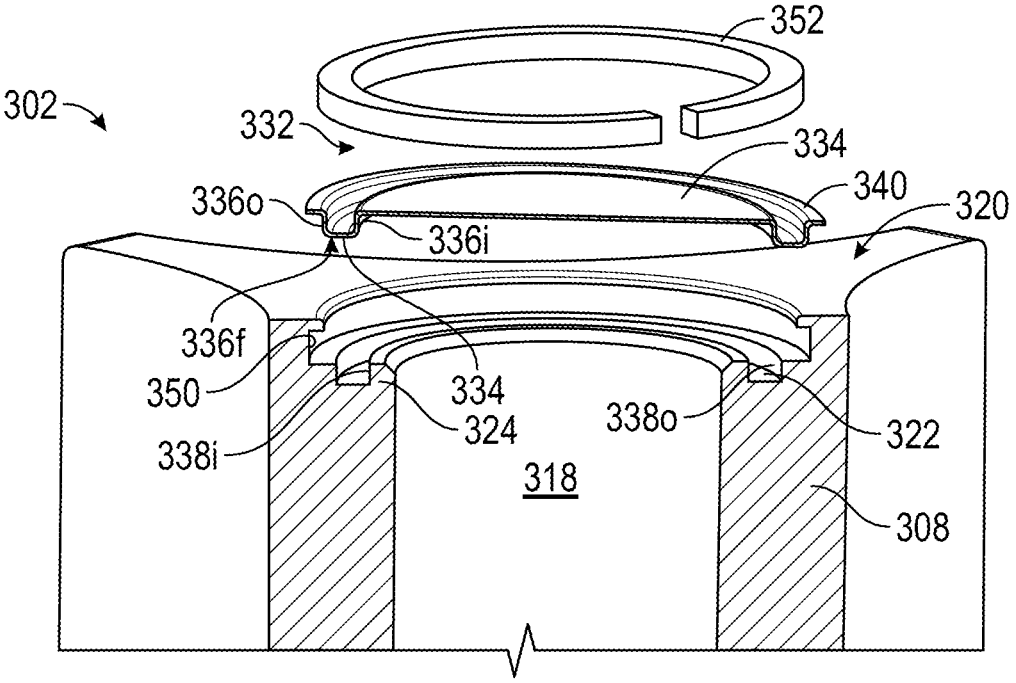
FIG. 11 is a partial cross-section of a projectile in accordance with a third embodiment shown in an expanded condition.
Figure 12:
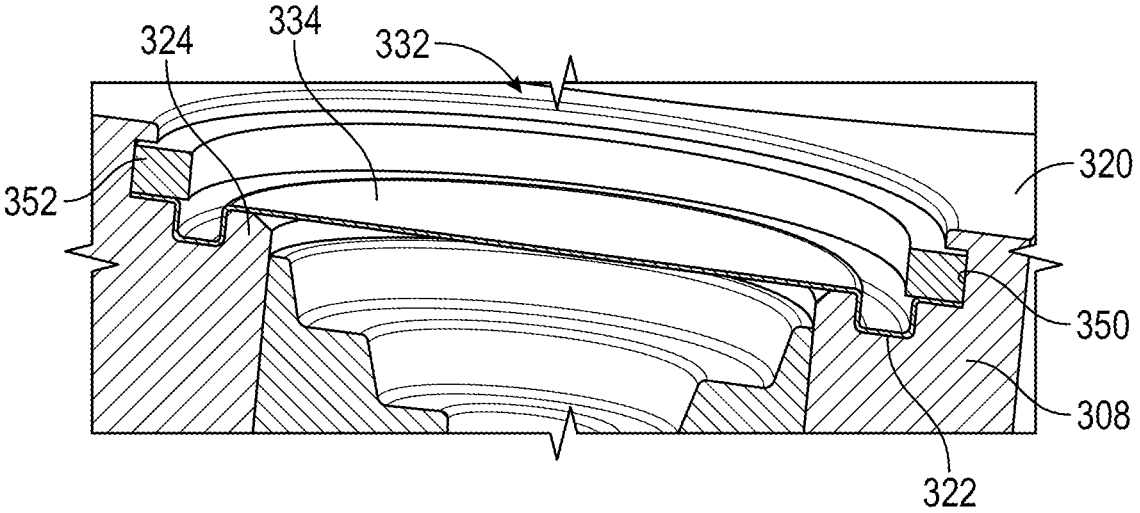
FIG. 12 is a partial cross-section of the projectile shown in FIG. 11 in an assembled condition.

With reference now to FIGS. 11-12, an embodiment of a projectile body 302 is illustrated. Projectile body 302, which is also similar to projectile body 102, includes certain modifications to the annular groove, the closure disk assembly and the retaining element as hereafter described. Similar features of projectile body 302 may be gleaned from the earlier description of projectile body 102 and tracer projectile 100, which will not be further explained.

The projectile body 302 includes a projectile base 308 having a tracer cavity 318 formed in a rear face 320 thereof. An annular groove 322 is also formed into the rear face 320 of the projectile base 308 to provide a ring flange 324 surrounding the tracer cavity 318. A radial channel 350 is formed in the annular groove 322 below the rear face 320 of the projectile base 308. A closure disk assembly 332 covers and seals the tracer cavity 318.

The closure disk assembly 332 is formed with a modified hat- or cup-shaped configuration having a thin-walled crown 334 covering the tracer cavity 318, a bead 336 extending into the annular groove 322 and a rim 340 extending into the radial channel 350. The bead 336 includes a pair of sidewalls 336*i*, 336*o* and a flange 336*f* extending therebetween. The ring flange 324 supports the crown 334 on the projectile base 308. The dimensions of the bead 336 relative to the radial surfaces 338*i*, 338*o* of the annular groove 322 may be configured to provide a slight press-fit joint which is held together by friction when the closure disk assembly 332 and the projectile base 308 are pushed together. An elastic split ring 352 functions as a retaining element for securing the closure disk assembly 332 to the projectile base 308 over the tracer cavity 318. Specifically, the split ring 352 is compressed and inserted into the annular groove 322 and partially positioned into the radial channel 350. Once so positioned, the compressive force is removed from the split ring 352 such that it radially expands into the radial channel 350 formed in the projectile base 308 and engages the rim 340 of the closure disk assembly 332 for securing the closure disk assembly 332 to the projectile base 308 over the tracer cavity 318.

Figure 13:
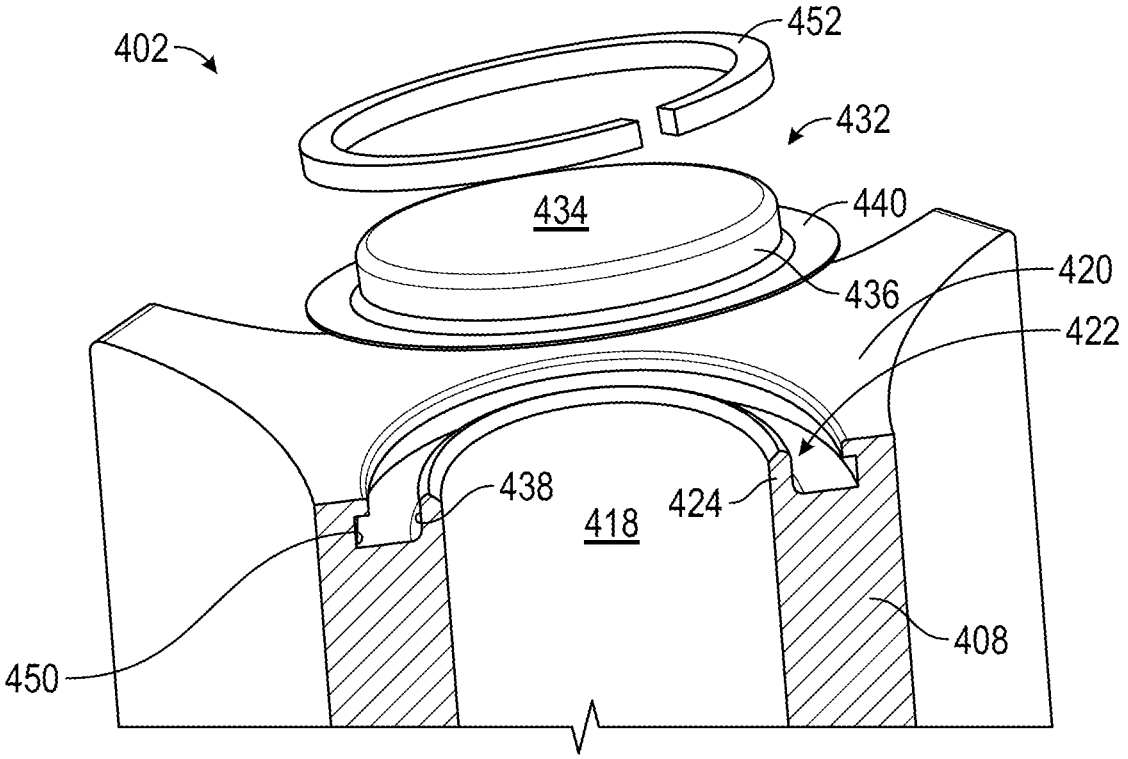
FIG. 13 is a partial cross-section of a projectile in accordance with a fourth embodiment shown in an expanded condition.
Figure 14:
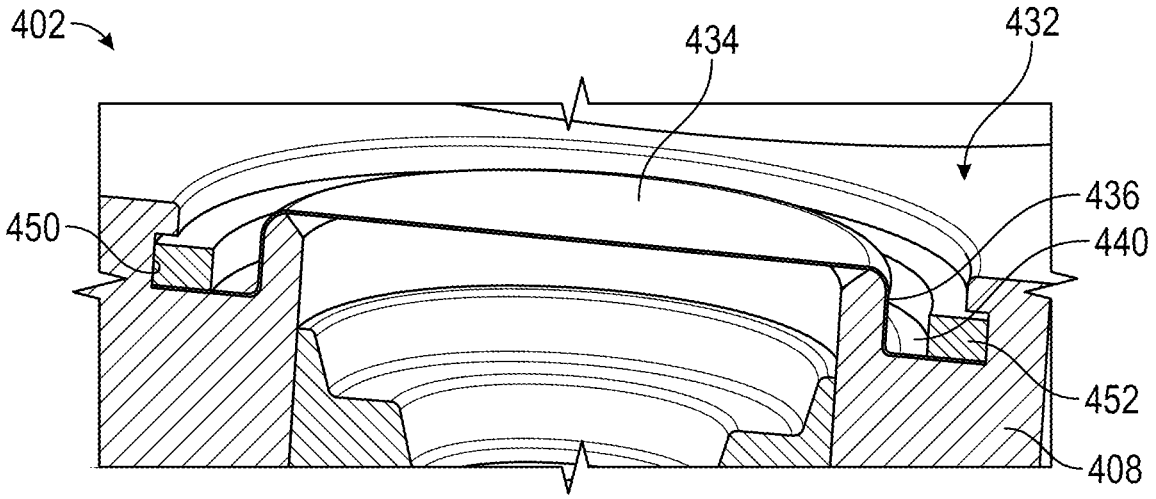
FIG. 14 is a partial cross-section of the projectile shown in FIG. 13 in an assembled condition.

With reference now to FIGS. 13-14, an embodiment of a projectile body 402 is illustrated. Projectile body 402, which is also similar to projectile body 102, includes certain modifications to the annular groove, the closure disk assembly and the retaining element as hereafter described. Similar features of projectile body 402 may be gleaned from the earlier description of projectile body 102 and tracer projectile 100, which will not be further explained.

The projectile body 402 includes a projectile base 408 having a tracer cavity 418 formed in a rear face 420 thereof. An annular groove 422 is also formed into the rear face 420 of the projectile base 408 to provide a ring flange 424 surrounding the tracer cavity 418. A radial channel 450 is formed at the bottom of the annular groove 422.

A closure disk assembly 432 covers and seals the tracer cavity 418. The closure disk assembly 432 is formed with a hat- or cup-shaped configuration having a thin-walled crown 434 covering the tracer cavity 418, a sidewall 436 extending into the annular groove 422 along an inner surface 438 of the annular groove 422 and a rim 440 extending into the radial channel 450. The ring flange 424 supports the crown 434 on the projectile base 408. The dimensions of the sidewall 436 relative to the inner surface 438 of the annular groove 422 may be configured to provide a slight press-fit joint which is held together by friction when these closure disk assembly 432 is pushed onto the ring flange 424. An elastic split ring 452 functions as a retaining element for securing the closure disk assembly 432 to the projectile base 408 over the tracer cavity 418. Specifically, the split ring 452 is compressed and inserted into the annular groove 422 and partially positioned into the radial channel 450. Once so positioned, the compressive force is removed from the split ring 452 such that it expands into the radial channel 450 formed in the projectile base 408 and engages the rim 440 of the closure disk assembly 432 for securing the closure disk assembly 432 to the projectile base 408 over the tracer cavity 418.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A tracer projectile comprising;

a projectile having a tracer cavity formed into a projectile base and an annular groove formed into a rear face of the projectile base to provide a ring flange surrounding the tracer cavity;

a pyrotechnic charge pressed into the tracer cavity, wherein the pyrotechnic charge is ignitable by burning propellant such that a trajectory of the projectile is visible when fired;

a closure disk assembly having a thin-walled crown covering the tracer cavity, a sidewall extending along an inner surface of the annular groove and a rim extending along an inner face of the annular groove, wherein the ring flange supports the crown on the projectile base such that the burning propellant ruptures the crown when the projectile is fired; and a retaining element disposed in the annular groove and engaging the rim for securing the closure disk assembly to the projectile base over the tracer cavity.

2. The tracer projectile of claim 1, the retaining element comprising a crimp set formed over the rim of the closure disk assembly.

3. The projectile of claim 2, the retaining element comprising a tapered crimping flange formed over the rim of the closure disk assembly.

4. The tracer projectile of claim 1, the retaining element comprising a split ring positioned over the rim of the closure disk assembly, wherein the split ring is disposed in a radial channel formed in the projectile base.

5. The tracer projectile of claim 1, the tracer closure disk further comprising a bead having a pair of sidewalls interconnected by a flange, wherein the bead is disposed in a first portion of the annular groove and the rim is disposed in a second portion of the annular groove.

6. The tracer projectile of claim 1, wherein the closure disk assembly is made of a metal selected from the group consisting of copper, copper alloy, aluminum, aluminum alloy, or steel.

7. The tracer projectile of claim 1, wherein the closure disk assembly is made of a polymeric material.

8. The tracer projectile of claim 1, wherein the projectile comprises a medium caliber projectile in a caliber range of 20 mm-40 mm.

9. The tracer projectile of claim 1, wherein the projectile comprises a large caliber projectile in a caliber range of 57 mm-155 mm.

10. The tracer projectile of claim 1, the projectile further comprising a plurality of fins formed in the projectile base.

11. A tracer projectile comprising;

a projectile body having a forward section supporting an ogive, a mid-section supporting a driving band and a base section having a tracer cavity formed therein and an annular groove formed into a rear face of the base section to provide a ring flange surrounding the tracer cavity;

a pyrotechnic charge pressed into the tracer cavity, wherein the pyrotechnic charge is ignitable by burning propellant such that a trajectory of the projectile is visible when fired;

a closure disk assembly having a thin-walled crown covering the tracer cavity, a sidewall extending along an inner surface of the annular groove and a rim extending along an inner face of the annular groove, wherein the ring flange supports the crown on the base section such that the burning propellant ruptures the crown when the projectile is fired; and a retaining element disposed in the annular groove and engaging the rim for securing the closure disk assembly to the base section over the tracer cavity.

12. The tracer projectile of claim 11, the retaining element comprising a crimp set formed over the rim of the closure disk assembly.

13. The projectile of claim 12, the retaining element comprising a tapered crimping flange formed over the rim of the closure disk assembly.

14. The tracer projectile of claim 11, the retaining element comprising a split ring positioned over the rim of the closure disk assembly, wherein the split ring is disposed in a radial channel formed in the base section.

15. The tracer projectile of claim 11, the tracer closure disk further comprising a bead having a pair of sidewalls interconnected by a flange, wherein the bead is disposed in a first portion of the annular groove and the rim is disposed in a second portion of the annular groove.

16. The tracer projectile of claim 11, wherein the closure disk assembly is made of a metal selected from the group consisting of copper, copper alloy, aluminum, aluminum alloy, brass or steel.

17. The tracer projectile of claim 11, wherein the closure disk assembly is made of a polymeric material.

18. The tracer projectile of claim 11, wherein the projectile body comprises a medium caliber projectile in a caliber range of 20-40 mm.

19. The tracer projectile of claim 11, wherein the projectile body comprises a large caliber projectile in a caliber range of 57-155 mm.

20. The tracer projectile of claim 11, wherein the projectile body comprises a plurality of fins formed in the base section.

* * * * *